US006966956B2

(12) United States Patent
Koizumi et al.

(10) Patent No.: US 6,966,956 B2
(45) Date of Patent: Nov. 22, 2005

(54) NI-BASED SINGLE CRYSTAL SUPER ALLOY

(75) Inventors: Yutaka Koizumi, Ryugasaki (JP); Toshiharu Kobayashi, Ryugasaki (JP); Tadaharu Yokokawa, Tsukuba (JP); Hiroshi Harada, Tsukuba (JP); Yasuhiro Aoki, Tokyo (JP); Mikiya Arai, Tokyo (JP); Shoju Masaki, Tokyo (JP); Ryoji Kakiuchi, Tokyo (JP); Kazuyoshi Chikugo, Kawasaki (JP)

(73) Assignees: National Institute for Materials Science, Ibaraki-Ken (JP); Ishikawajima-Harima Heavy Industries Co., Ltd., Tokyo (JP)

( * ) Notice: Subject to any disclaimer, the term of this patent is extended or adjusted under 35 U.S.C. 154(b) by 0 days.

(21) Appl. No.: 10/899,167

(22) Filed: Jul. 26, 2004

(65) Prior Publication Data

US 2005/0051242 A1 Mar. 10, 2005

Related U.S. Application Data

(63) Continuation-in-part of application No. 10/159,202, filed on May 30, 2002, now abandoned.

(30) Foreign Application Priority Data

May 30, 2001 (JP) ..... 2001-161919
May 17, 2002 (JP) ..... 2002-143572

(51) Int. Cl.[7] ..... C22C 19/05
(52) U.S. Cl. ..... 148/428; 420/444; 420/445
(58) Field of Search ..... 148/428; 420/444, 420/445

(56) References Cited

U.S. PATENT DOCUMENTS

| | | | |
|---|---|---|---|
| 4,582,548 | A | 4/1986 | Harris et al. |
| 4,643,782 | A | 2/1987 | Harris et al. |
| 4,719,080 | A | 1/1988 | Duhl et al. |
| 4,935,072 | A | 6/1990 | Nguyen-Dinh |
| 5,151,249 | A | 9/1992 | Austin et al. |
| 5,366,695 | A | 11/1994 | Erickson |
| 5,455,120 | A | 10/1995 | Walston et al. |
| 5,482,789 | A | 1/1996 | O'Hara et al. |
| 6,007,645 | A | 12/1999 | Cetel et al. |
| 6,444,057 | B1 | 9/2002 | Darolia et al. |
| 2002/0062886 | A1 | 5/2002 | Hino et al. |
| 2003/0075247 | A1 | 4/2003 | Koizumi et al. |

FOREIGN PATENT DOCUMENTS

| | | |
|---|---|---|
| EP | 0 434 996 A1 | 7/1991 |
| EP | 0 848 071 A1 | 6/1998 |
| EP | 1 184 473 A2 | 3/2002 |
| FR | 2 780 983 | 7/1998 |
| JP | 2000-239771 | 9/2000 |

*Primary Examiner*—John P. Sheehan
(74) *Attorney, Agent, or Firm*—Fish & Richardson P.C.

(57) ABSTRACT

A Ni-based single crystal super alloy capable of improving strength by preventing precipitation of a TCP phase at high temperatures may be obtained by a Ni-based single crystal super alloy having a composition consisting of 5.0–7.0 wt % Al, 4.0–8.0 wt % Ta, 2.9–4.5 wt % Mo, 4.0–8.0 wt % W, 3.0–6.0 wt % Re, 0.01–0.50 wt % Hf, 2.0–5.0 wt % Cr, 0.1–15.0 wt % Co and 1.0–4.0 wt % Ru in terms of its weight ratio, with the remainder consisting of Ni and unavoidable impurities. Preferably, the composition of Co in the Ni-based single crystal super alloy is limited to 0.1–9.5 wt %.

6 Claims, 2 Drawing Sheets

Relationship between change of the misfit in the alloy based on TMS-138 and creep rupture life of the alloy. (creep rupture life of TMS-138 is set up to 100%)

Relationship between calculated values of misfit and actual observed values of misfit.
(Number of Samples: 17, Multiple Regression Coefficient: R=0.95)

Relationship between change of the misfit in the alloy based on TMS-138 and creep rupture life of the alloy.
(creep rupture life of TMS-138 is set up to 100%)

NI-BASED SINGLE CRYSTAL SUPER ALLOY

CROSS-REFERENCE TO RELATED APPLICATIONS

This application claims the benefit of priority of U.S. Ser. No. 10/159,202, filed on May 30, 2002 now abandoned, which is incorporated herein by reference.

BACKGROUND

1. Field of the Invention

The present invention relates to a Ni-based single crystal super alloy, and more particularly, to a technology employed for improving the creep characteristics of Ni-based single crystal super alloy.

2. Description of the Related Art

An example of the typical composition of Ni-based single crystal super alloy developed for use as a material for moving and stationary blades subject to high temperatures such as those in aircraft and gas turbines is shown in Table 1.

TABLE 1

| Alloy | Elements (wt %) | | | | | | | | | | | | | |
|---|---|---|---|---|---|---|---|---|---|---|---|---|---|---|
| name | Al | Ti | Ta | Nb | Mo | W | Re | C | Zr | Hf | Cr | Co | Ru | Ni |
| CMSX-2 | 6.0 | 1.0 | 6.0 | — | 1.0 | 8.0 | — | — | — | — | 8.0 | 5.0 | — | Rem |
| CMSX-4 | 5.6 | 1.0 | 6.5 | — | 0.6 | 6.0 | 3.0 | — | — | — | 6.5 | 9.0 | — | Rem |
| Rene'N6 | 6.0 | — | 7.0 | 0.3 | 1.0 | 6.0 | 5.0 | — | — | 0.2 | 4.0 | 13.0 | — | Rem |
| CMSX-10K | 5.7 | 0.3 | 8.4 | 0.1 | 0.4 | 5.5 | 6.3 | — | — | 0.03 | 2.3 | 3.3 | — | Rem |
| 3B | 5.7 | 0.5 | 8.0 | — | — | 5.5 | 6.0 | 0.05 | — | 0.15 | 5.0 | 12.5 | 3.0 | Rem |

In the above-mentioned Ni-based single crystal super alloys, after performing solution treatment at a prescribed temperature, aging treatment is performed to obtain an Ni-based single crystal super alloy. This alloy is referred to as a so-called precipitation hardened alloy, and has a from in which the precipitation phase in the form of a γ' phase is precipitated in a matrix in the form of a γ phase.

Among the alloys listed in Table 1, CMSX-2 (Canon-Muskegon, U.S. Pat. No. 4,582,548) is a first-generation alloy, CMSX-4 (Canon-Muskegon, U.S. Pat. No. 4,643,782) is a second-generation alloy, Rene'N6 (General Electric, U.S. Pat. No. 5,455,120) and CMSX-10K (Canon-Muskegon, U.S. Pat. No. 5,366,695) are third-generation alloys, and 3B (General Electric, U.S. Pat. No. 5,151,249) is a fourth-generation alloy.

Although the above-mentioned CMSX-2, which is a first-generation alloy, and CMSX-4, which is a second-generation alloy, have comparable creep strength at low temperatures, since a large amount of the eutectic γ' phase remains following high-temperature solution treatment, their creep strength is inferior to third-generation alloys.

In addition, although the third-generation alloys of Rene'N6 and CMSX-10 are alloys designed to have improved creep strength at high temperatures in comparison with second-generation alloys, since the composite ratio of Re (5 wt % or more) exceeds the amount of Re that dissolves into the matrix (γ phase), the excess Re compounds with other elements and as a result, a so-called TCP (topologically close packed) phase precipitates at high temperatures causing the problem of decreased creep strength.

In addition, making the lattice constant of the precipitation phase (γ' phase) slightly smaller than the lattice constant of the matrix (γ phase) is effective in improving the creep strength of Ni-based single crystal super alloys. However, since the lattice constant of each phase fluctuates greatly fluctuated according to the composite ratios of the composite elements of the alloy, it is difficult to make fine adjustments in the lattice constant and as a result, there is the problem of considerable difficulty in improving creep strength.

In consideration of the above circumstances, the object of the present invention is to provide a Ni-based single crystal super alloy that makes it possible to improve strength by preventing precipitation of the TCP phase at high temperatures.

SUMMARY

The following constitution is employed in the present invention in order to achieve the above object.

In one implementation, the Ni-based single crystal super alloy of the present invention is characterized by having a composition consisting of 5.0–7.0 wt % Al, 4.0–8.0 wt % Ta, 2.9–4.5 wt % Mo, 4.0–8.0 wt % W, 3.0–6.0 wt % Re, 0.01–0.50 wt % Hf, 2.0–5.0 wt % Cr, 0.1–15.0 wt % Co and 1.0–4.0 wt % Ru in terms of its weight ratio, with the remainder consisting of Ni and unavoidable impurities.

In another implementation, the Ni-based single crystal super alloy of the present invention is characterized by having a composition consisting of 5.0–7.0 wt % Al, 4.0–6.0 wt % Ta, 1.0–4.5 wt % Mo, 4.0–8.0 wt % W, 3.0–6.0 wt % Re, 0.01–0.50 wt % Hf, 2.0–5.0 wt % Cr, 0.1–15.0 wt % Co, and 1.0–4.0 wt % Ru in terms of weight ratio, with the remainder consisting of Ni and unavoidable impurities.

In yet a further implementation, the Ni-based single crystal super alloy of the present invention is characterized by having a composition consisting of 5.0–7.0 wt % Al, 4.0–6.0 wt % Ta, 2.9–4.5 wt % Mo, 4.0–8.0 wt % W, 3.0–6.0 wt % Re, 0.01–0.50 wt % Hf, 2.0–5.0 wt % Cr, 0.1–15.0 wt % Co and 1.0–4.0 wt % Ru in terms of weight ratio, with the remainder consisting of Ni and unavoidable impurities.

Preferably, the composition of Co in the Ni-based single crystal super alloy is in the rage of 0.1–9.5 wt %.

According to the above Ni-based single crystal super alloy, precipitation of the TCP phase, which causes a decrease in creep strength, during use at high temperatures is inhibited by the addition of Ru. In addition, by setting the composite ratios of other composite elements within their optimum ranges, the lattice constant of the matrix (γ phase) and the lattice constant of the precipitation phase (γ' phase) can be made to have optimum values. Consequently, strength at high temperatures can be enhanced.

In addition, the Ni-based single crystal super alloy of the present invention is characterized by having a composition consisting of 5.9 wt % Al, 5.9 wt % Ta, 2.9 wt % Mo, 5.9 wt % W, 4.9 wt % Re, 0.10 wt % Hf, 2.9 wt % Cr, 5.9 wt % Co and 2.0 wt % Ru in terms of weight ratio, with the remainder consisting of Ni and unavoidable impurities, in the Ni-based single crystal super alloys previously described.

According to an Ni-based single crystal super alloy having this composition, the creep endurance temperature at 137 MPa and 1000 hours can be made to be 1356 K (1083° C.).

Moreover, the Ni-based single crystal super alloy of the present invention is characterized by $a2 \leqq 0.999a1$ when the lattice constant of the matrix is taken to be a1 and the lattice constant of the precipitation phase is taken to be a2 in the Ni-based single crystal super alloys previously described.

According to this Ni-based single crystal super alloy, the relationship between a1 and a2 is such that $a2 \leqq 0.999a1$ when the lattice constant of the matrix is taken to be a1 and the lattice constant of the precipitation phase is taken to be a2, and since the lattice constant a2 of the precipitation phase is −0.1% or less of the lattice constant a1 of the matrix, the precipitation phase that precipitates in the matrix precipitates so as to extend continuously in the direction perpendicular to the direction of the load. As a result, strength at high temperatures can be enhanced without dislocation defects moving within the alloy structure under stress.

DETAILED DESCRIPTION

Figure 1:
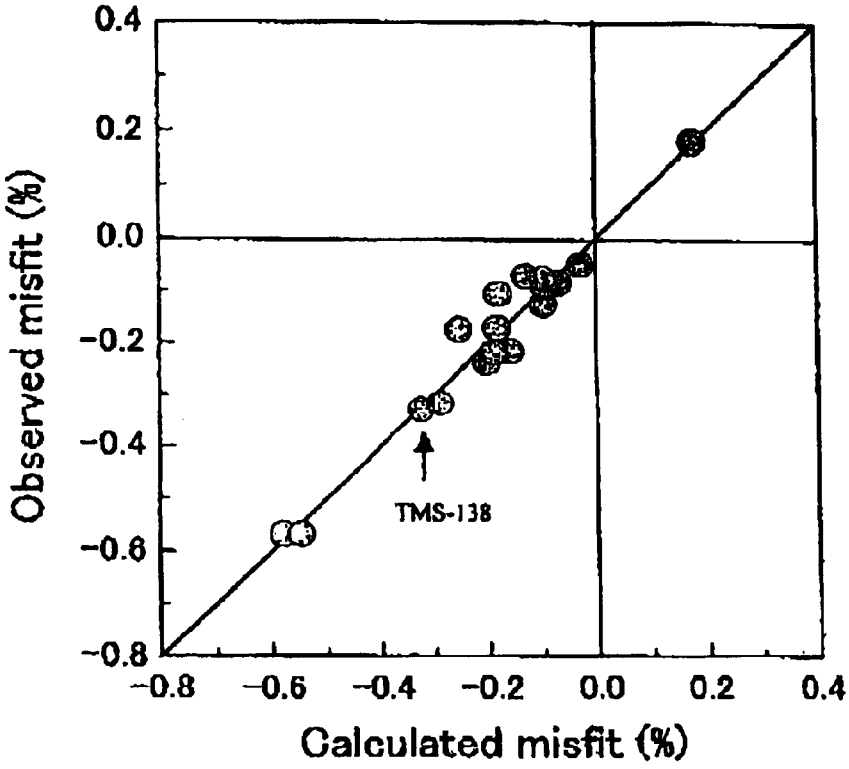
FIG. 1 shows a relationship between calculated values of misfit and actual observed values of misfit.

The following provides a detailed explanation for carrying out the present invention.

The Ni-based single crystal super alloy of the present invention is an alloy comprised of Al, Ta, Mo, W, Re, Hf, Cr, Co, Ru, Ni (remainder) and unavoidable impurities.

The above Ni-based single crystal super alloy is an alloy having a composition consisting of 5.0–7.0 wt % Al, 4.0–8.0 wt % Ta, 2.9–4.5 wt % Mo, 4.0–8.0 wt % W, 3.0–6.0 wt % Re, 0.01–0.5 wt % Hf, 2.0–5.0 wt % Cr, 0.1–15.0 wt % Co and 1.0–4.0 wt % Ru, with the remainder consisting of Ni and unavoidable impurities.

In addition, the above Ni-based single crystal super alloy is an alloy having a composition consisting of 5.0–7.0 wt % Al, 4.0–6.0 wt % Ta, 1.0–4.5 wt % Mo, 4.0–8.0 wt % W, 3.0–6.0 wt % Re, 0.01–0.5 wt % Hf, 2.0–5.0 wt % Cr, 0.1–15.0 wt % Co and 1.0–4.0 wt % Ru, with the remainder consisting of Ni and unavoidable impurities.

Moreover, the above Ni-based single crystal super alloy is an alloy having a composition consisting of 5.0–7.0 wt % Al, 4.0–6.0 wt % Ta, 2.9–4.5 wt % Mo, 4.0–8.0 wt % W, 3.0–6.0 wt % Re, 0.01–0.5 wt % Hf, 2.0–5.0 wt % Cr, 0.1–15.0 wt % Co and 1.0–4.0 wt % Ru, with the remainder consisting of Ni and unavoidable impurities.

All of the above alloys have an austenite phase in the form of a γ phase (matrix) and an intermediate regular phase in the form of a γ' phase (precipitation phase) that is dispersed and precipitated in the matrix. The γ' phase is mainly composed of an intermetallic compound represented by $Ni_3Al$, and the strength of the Ni-based single crystal super alloy at high temperatures is improved by this γ' phase.

Cr is an element that has superior oxidation resistance and improves the high-temperature corrosion resistance of the Ni-based single crystal super alloy. The composite ratio of Cr is preferably within the range of 2.0 wt % or more to 5.0 wt % or less, and more preferably 2.9 wt %. If the composite ratio of Cr is less than 2.0 wt %, the desired high-temperature corrosion resistance cannot be secured, thereby making this undesirable. If the composite ratio of Cr exceeds 5.0 wt %, in addition to precipitation of the γ' phase being inhibited, harmful phases such as a σ phase or μ phase form that cause a decrease in strength at high temperatures, thereby making this undesirable.

In addition to improving strength at high temperatures by dissolving into the matrix in the form of the γ phase in the presence of W and Ta, Mo also improves strength at high temperatures due to precipitation hardening. The composite ratio of Mo is preferably within the range of 1.0 wt % or more to 4.5 wt % or less, more preferably within the range of 2.9 wt % or more to 4.5 wt % or less, and most preferably 2.9 wt %. If the composite ratio of Mo is less than 1.0 wt %, strength at high temperatures cannot be maintained at the desired level, thereby making this undesirable. If the composite ratio of Mo exceeds 4.5 wt %, strength at high temperatures decreases, and corrosion resistance at high temperatures also decreases, thereby making this undesirable.

W improves strength at high temperatures due to the actions of solution hardening and precipitation hardening in the presence of Mo and Ta as previously mentioned. The composite ratio of W is preferably within the range of 4.0 wt % or more to 8.0 wt % or less, and most preferably 5.9 wt %. If the composite ratio of W is less than 4.0 wt %, strength at high temperatures cannot be maintained at the desired level, thereby making this undesirable. If the composite ratio of W exceeds 8.0 wt %, high-temperature corrosion resistance decreases, thereby making this undesirable.

Ta improves high-temperature strength due to the actions of solution hardening and precipitation hardening in the presence of Mo and W as previously mentioned, and also improves high-temperature strength as a result of a portion of the Ta undergoing precipitation hardening relative to the γ' phase. The composite ratio of Ta is preferably within the range of 4.0 wt % or more to 8.0 wt % or less, more preferably within the range of 4.0 wt % or more to 6.0 wt % or less, and most preferably 5.9 wt %. If the composite ratio of Ta is less than 4.0 wt %, strength at high temperatures cannot be maintained at the desired level, thereby making this undesirable. If the composite ratio of Ta exceeds 8.0 wt %, the σ phase and μ phase form that cause a decrease in strength at high temperatures, thereby making this undesirable.

Al improves high-temperature strength by compounding with Ni to form an intermetallic compound represented by $Ni_3Al$, which composes the γ' phase that finely and uniformly disperses and precipitates in the matrix, at a ratio of 60–70% in terms of volume percent. The composite ratio of Al is preferably within the range of 5.0 wt % or more to 7.0 wt % or less, and most preferably 5.9 wt %. If the composite ratio of Al is less than 5.0 wt %, the precipitated amount of the γ' phase becomes insufficient, and strength at high temperatures cannot be maintained at the desired level, thereby making this undesirable. If the composite ratio of Al exceeds 7.0 wt %, a large amount of a coarse γ phase referred to as the eutectic γ' phase is formed, and this eutectic γ' phase prevents solution treatment and makes it impossible to maintain strength at high temperatures at a high level, thereby making this undesirable.

Hf is an element that segregates at the grain boundary and improves high-temperature strength by strengthening the grain boundary as a result of being segregated at the grain boundary between the γ phase and γ' phase. The composite ratio of Hf is preferably within the range of 0.01 wt % or more to 0.50 wt % or less, and most preferably 0.10 wt %. If the composite ratio of Hf is less than 0.01 wt %, the precipitated amount of the γ' phase becomes insufficient and strength at high temperatures cannot be maintained at the desired level, thereby making this undesirable. If the composite ratio of Hf exceeds 0.50 wt %, local melting is induced which results in the risk of decreased strength at high temperatures, thereby making this undesirable.

Co improves strength at high temperatures by increasing the solution limit at high temperatures relative to the matrix such as Al and Ta, and dispersing and precipitating a fine γ' phase by heat treatment. The composite ratio of Co is preferably within the range of 0.1 wt % or more to 15.0 wt % or less, and most preferably 5.9 wt %. If the composite ratio of Co is less than 0.1 wt %, the precipitated amount of the γ' phase becomes insufficient and the strength at high temperatures cannot be maintained, thereby making this undesirable. If the composite ratio of Co exceeds 15.0 wt %, the balance with other elements such as Al, Ta, Mo, W, Hf and Cr is disturbed resulting in the precipitation of harmful phases that cause a decrease in strength at high temperatures, thereby making this undesirable.

Re improves high-temperature strength due to solution strengthening as a result of dissolving in the matrix in the form of the γ phase. On the other hand, if a large amount of Re is added, the harmful TCP phase precipitates at high temperatures, resulting in the risk of decreased strength at high temperatures. Thus, the composite ratio of Re is preferably within the range of 3.0 wt % or more to 6.0 wt % or less, and most preferably 4.9 wt %. If the composite ratio of Re is less than 3.0 wt %, solution strengthening of the γ phase becomes insufficient and strength at high temperatures cannot be maintained at the desired level, thereby making this undesirable. If the composite ratio of Re exceeds 6.0 wt %, the TCP phase precipitates at high temperatures and strength at high temperatures cannot be maintained at a high level, thereby making this undesirable.

Ru improves high-temperature strength by inhibiting precipitation of the TCP phase. The composite ratio of Ru is preferably within the range of 1.0 wt % or more to 4.0 wt % or less, and most preferably 2.0 wt %. If the composite ratio of Ru is less than 1.0 wt %, the TCP phase precipitates at high temperatures and strength at high temperatures cannot be maintained at a high level, thereby making this undesirable. If the composite ratio of Ru exceeds 4.0 wt %, the cost increases which is also undesirable.

Particularly in the present invention, by adjusting the composite ratios of Al, Ta, Mo, W, Hf, Cr, Co and Ni to the optimum ratios, together with improving strength at high temperatures by setting the lattice constant of the γ phase and the lattice constant of the γ' phase within their optimum ranges, and precipitation of the TCP phase can be inhibited by adding Ru.

In addition, in usage environments at a high temperature from 1273 K (1000° C.) to 1373K (1100° C.), when the lattice constant of the crystals that compose the matrix in the form of the γ phase is taken to be a1, and the lattice constant of the crystals that compose the precipitation phase in the form of the γ' phase is taken to be a2, then the relationship between a1 and a2 is preferably such that $a2 \leqq 0.999a1$. Namely, lattice constant a2 of the crystals of the precipitation phase is preferably −0.1% or less lattice constant a1 of the crystals of the matrix.

In addition, lattice constant a2 of the crystals of the precipitation phase should be −0.5% or more of lattice constant a1 of the crystals of the matrix. In the case both of the lattice constants are in the above relationship, since the precipitation phase precipitates so as to extend continuously in the direction perpendicular to the direction of the load when the precipitation phase precipitates in the matrix due to heat treatment, creep strength can be enhanced without movement of dislocation defects in the alloy structure in the presence of stress.

In order to make the relationship between lattice constant a1 and lattice constant a2 such that $a2 \leqq 0.999a1$, the composition of the composite elements that compose the Ni-based single crystal super alloy is suitably adjusted.

According to the above Ni-based super crystal super alloy, precipitation of the TCP phase, which causes decreased creep strength, during use at high temperatures is inhibited by addition of Ru. In addition, by setting the composite ratios of other composite elements to their optimum ranges, the lattice constant of the matrix (γ phase) and the lattice constant of the precipitation phase (γ' phase) can be made to have optimum values. As a result, creep strength at high temperatures can be improved.

Embodiments

The effect of the present invention is shown using following embodiments.

Melts of various Ni-based single crystal super alloys were prepared using a vacuum melting furnace, and alloy ingots were cast using the alloy melts. The composite ratio of the alloy ingot of the present embodiment (TMS-138) is shown in Table 2.

TABLE 2

| | Elements (wt %) | | | | | | | | | | | | | |
|---|---|---|---|---|---|---|---|---|---|---|---|---|---|---|
| Sample (alloy name) | Al | Ti | Ta | Nb | Mo | W | Re | C | Zr | Hf | Cr | Co | Ru | Ni |
| Embodiment (TMS-138) | 5.9 | | 5.9 | | 2.9 | 5.9 | 4.9 | | | 0.1 | 2.9 | 5.9 | 2.0 | Rem |

Next, solution treatment and aging treatment were performed on the alloy ingots followed by observation of the state of the alloy structure with a scanning electron microscope (SEM). Solution treatment consisted of holding for 1 hour at 1573K (1300° C.) followed by heating to 1613K (1340° C.) and holding for 5 hours. In addition, aging treatment consisted of consecutively performing primary aging treatment consisting of holding for 4 hours at 1150° C. and secondary aging treatment consisting of holding for 20 hours at 870° C.

As a result, a TCP phase was unable to be confirmed in the structure.

Next, a creep test was performed on a sample of the present embodiment (TMS-138) that underwent solution treatment and aging treatment. The creep test consisted of measuring the time until the sample demonstrated creep rupture as the sample life under each of the temperature and stress conditions shown in Table 3.

TABLE 3

| Sample (alloy name) | Creep test conditions/rupture life (h) | | | | |
|---|---|---|---|---|---|
| | 1173 K (900° C.) 392 MPa | 1273 K (1000° C.) 245 MPa | 1373 K (1100° C.) 137 MPa | 1423 K (1150° C.) 98 Mpa | 1423 K (1150° C.) 137 MPa |
| Embodiment (TMS-138) | 986.88 | 380.50 | 412.30 | 343.25 | 81.47 |

As is clear from Table 3, the sample of the present embodiment was determined to have high strength even under high temperature conditions of 1273K (1000° C.).

In addition, the creep rupture characteristics (withstand temperature) were compared for the alloys of the prior art shown in Table 1 (Comparative Examples 1 through 5) and the sample of the present embodiment shown in Table 2 (TMS-138). Creep rupture characteristics were determined either as a result of measuring the temperature until the sample ruptured under conditions of applying stress of 137 MPa for 1000 hours, or converting the rupture temperature of the sample under those conditions.

TABLE 4

| Sample (alloy name) | Withstand temperature (° C.) |
|---|---|
| Comparative Example 1 (CMSX-2) | 1289 K (1016° C.) |
| Comparative Example 2 (CMSX-4) | 1306 K (1033° C.) |
| Comparative Example 3 (Rene'N6) | 1320 K (1047° C.) |
| Comparative Example 4 (CMSX-10K) | 1345 K (1072° C.) |
| Comparative Example 5 (3B) | 1353 K (1080° C.) |
| Embodiment (TMS-138) | 1356 K (1083° C.) |

(Converted to 137 MPa, 1000 hours)

As is clear from Table 4, the sample of the present embodiment was determined to have a high withstand temperature (1356K (1083° C.)) equal to or greater than Comparative Examples 1 through 5.

Thus, this alloy has a higher heat resistance temperature than Ni-based single crystal super alloys of the prior art, and was determined to have high strength even at high temperatures.

Furthermore, the fatigue strength were compared for the alloys of the Comparative Example 2 shown in Table 1 (CMSX-4) and the sample of the present embodiment shown in Table 2 (TMS-138). In this case, the high cycle fatigue strength (HCF) and the low cycle fatigue strength (LCF) were measured as the fatigue strength. For measuring the high cycle fatigue strength, the max stress at high temperature of 1373K (1100° C.) were measured by controlling a load, and the number of fatigue fracture cycle (Nf) were determined as $10^6$ and $10^7$. For measuring the low cycle fatigue strength, the alternative peseudostress at high temperature of 1073K (800° C.) were measured by controlling the distortion, and the number of fatigue fracture cycle (Nf) were determined as $10^3$ and $10^4$.

TABLE 5

| | HCF(1373 K) Max Stress (Mpa) | | LCF(1073 K) Alt. Pseudostress (Mpa) | |
|---|---|---|---|---|
| | Nf = $10^6$ | Nf = $10^7$ | Nf = $10^3$ | Nf = $10^4$ |
| TMS-138 | 388 | 252 | 833 | 611 |
| CMSX4 | 305 | 238 | 699 | 507 |

As is clear from Table 5, the sample of the present embodiment was determined to have a fatigue strength greater than Comparative Example 2.

Therefore, the alloy of the present invention (TMS-138) was determined to have a high fatigue strength in addition to the Creep strength at high temperature compared to the conventional Ni-based single crystal super alloy.

Furthermore, it is preferable that the composition of Co in the Ni-based single crystal super alloy be limited to 0.1–9.5 wt %. The reason for this limitation is explained below.

As explained above, in the alloy, when the lattice constant of the matrix is taken to be a1 and the lattice constant of the precipitation phase is taken to be a2, it is preferable that $a2 \leqq 0.999a1$, and this means that the lattice constant a2 of the crystals of the precipitation phase is −0.1% or lower than the lattice constant a1 of the crystals of the matrix. In the following descriptions, this percentage of the lattice constant a2 relative to the lattice constant a1 is called "misfit". In the alloy, in order to enhance the creep strength of the alloy to the desired level, the misfit should be reduced to −0.1% or less.

According to research by the applicants, the misfit can be calculated from the following equation.

$$\text{Misfit}(\%)=0.154+0.013\text{Co}-0.012\text{Cr}-0.086\text{Mo}-0.016\text{W}+0.002\text{Al}-0.003\,\text{Ta}+0.316\text{Hf}-0.058\text{Re}+0.041\text{Ru}$$ (all elements in the equation are in wt % amounts)

Here, as shown in the FIG. 1, calculated values of the misfit based on this equation agreed very well with the actual observed values of the misfit.

In the present invention, the added amount of Co in the alloy is reduced in order to reduce the misfit, since Co is the most easily changeable element in the alloy without affecting other characteristics of the alloy.

Table 6 shows the change of the misfit according to the change of the added amount of Co in the alloy of an embodiment (TMS-138) of the present invention. In Table 6, the top line shows data of the original TMS-138 alloy, and the misfit of each alloy is calculated by the above equation.

TABLE 6

| Misfit | Elements (wt %) | | | | | | | | |
|---|---|---|---|---|---|---|---|---|---|
| | Co | Cr | Mo | W | Al | Ta | Hf | Re | Ru |
| −0.328 | 5.88 | 2.94 | 2.94 | 5.88 | 5.88 | 5.88 | 0.10 | 4.90 | 2.00 |
| −0.381 | 1.80 | " | " | " | " | " | " | " | " |
| −0.355 | 3.80 | " | " | " | " | " | " | " | " |
| −0.329 | 5.80 | " | " | " | " | " | " | " | " |
| −0.303 | 7.80 | " | " | " | " | " | " | " | " |
| −0.277 | 9.80 | " | " | " | " | " | " | " | " |
| −0.251 | 11.80 | " | " | " | " | " | " | " | " |
| −0.225 | 13.80 | " | " | " | " | " | " | " | " |

As shown in Table 6, in the alloys based on the TMS-138 alloy, the misfit is always −0.1% or less, and is reduced in proportion to the reduction of the added amount of Co.

As a result of further research by the applicants, the misfit is always −0.1% or less when the composition of Co in the alloy is 9.5 wt % or less. The following Table 7 shows an example in which the misfit becomes −0.1% or less when the composition of Co in the alloy is 9.5 wt % or less in the alloy.

TABLE 7

| | Elements (wt %) | | | | | | | | |
|---|---|---|---|---|---|---|---|---|---|
| Misfit | Co | Cr | Mo | W | Al | Ta | Hf | Re | Ru |
| −0.235 | 0.10 | 3.00 | 3.00 | 5.00 | 5.38 | 5.38 | 0.45 | 4.40 | 2.50 |
| −0.206 | 2.30 | " | " | " | " | " | " | " | " |
| −0.190 | 3.50 | " | " | " | " | " | " | " | " |
| −0.173 | 4.80 | " | " | " | " | " | " | " | " |
| −0.159 | 5.88 | " | " | " | " | " | " | " | " |
| −0.146 | 6.90 | " | " | " | " | " | " | " | " |
| −0.133 | 7.90 | " | " | " | " | " | " | " | " |
| −0.125 | 8.50 | " | " | " | " | " | " | " | " |
| −0.112 | 9.50 | " | " | " | " | " | " | " | " |
| −0.098 | 10.60 | " | " | " | " | " | " | " | " |
| −0.089 | 11.30 | " | " | " | " | " | " | " | " |
| −0.069 | 12.80 | " | " | " | " | " | " | " | " |
| −0.053 | 14.10 | " | " | " | " | " | " | " | " |

Furthermore, as described above, the misfit is highly related to the strength of the alloy. That is, the strength of the alloy is increased in accordance with the increase of the negative quantity of the misfit.

Figure 2:
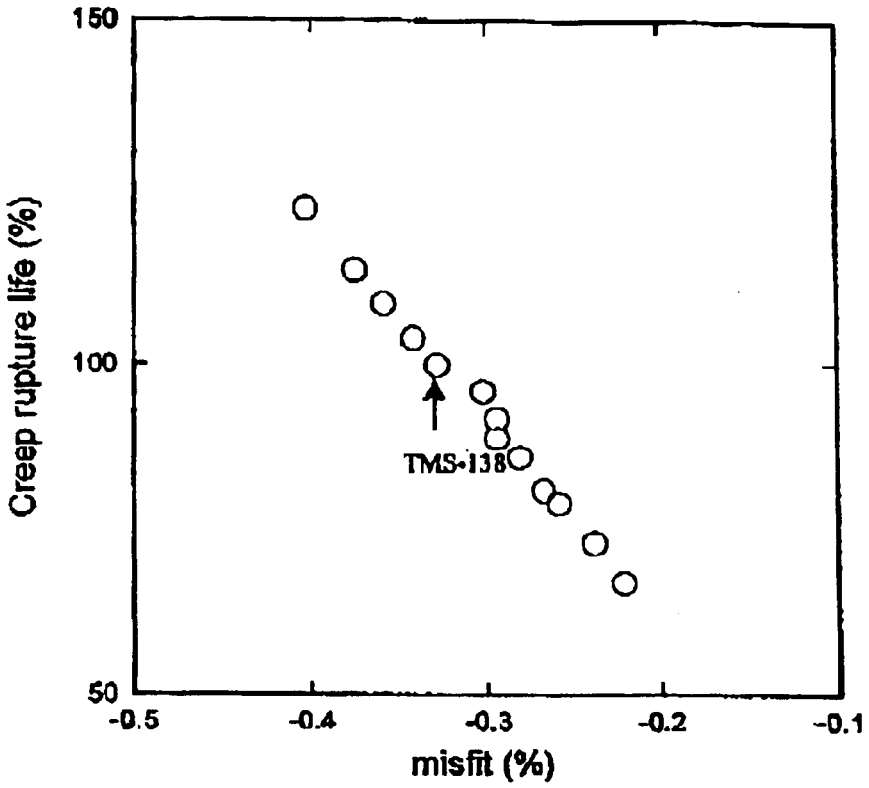
FIG. 2 shows a relationship between change of the misfit in the alloy based on TMS-138 and creep rupture life of the alloy

The attached FIG. 2 shows a relationship between the change of the misfit according to the change of the added amount of Co in the alloy based on the TMS-138 alloy and the strength (creep rupture life) of the alloy. In FIG. 2, each creep rupture life is calculated by setting the misfit of the original TMS-138 alloy to 100%. As shown in FIG. 2, in the alloys based on the TMS-138 alloy, it is clear that the strength is increased in accordance with the increase of the negative quantity of the misfit. Furthermore, in FIG. 2, the relationship between the misfit and the strength of the alloy is changed when the misfit is near −0.3% (that is, when the composition of Co in the alloy is approximately 8 to 9 wt %, more exactly, is 8.0 to 9.5 wt %). In this case, when the misfit is approximately −0.3% or less, the ratio of increase of the strength to the variation of the misfit is increased against when the misfit is higher than −0.3%. Therefore, the composition of Co in the alloy is 9.5 wt % or less is advantageous for increasing the strength of the alloy.

According to yet further research by the applicants, it is preferable that the composition of Co in the alloy be 9.5 wt % or less (more preferably 8.0 wt % or less) in the alloy, for maintaining the strength of the alloy to the desirable level.

In addition, "P" value is disclosed in U.S. Pat. No. 6,007,645 (hereinafter called "U.S. Pat. No. '645"), as a parameter for the Creep strength at high temperature, oxidation resistance, and corrosion resistance.

In U.S. Pat. No. '645, the Creep strength at high temperature, oxidation resistance, and corrosion resistance are improved by decreasing Cr content in the alloy, and P value (=−200 Cr+80 Mo−20 $Mo^2$+200 W−14 $W^2$+30 Ta−1.5 $Ta^2$+2.5 Co+1200 Al−100 $A^2$+100 Re+1000 Hf−2000 $Hf^2$+700 $Hf^3$, wherein all elements in the formula are in wt % amounts) is preferably be 4500 or higher. However, in the alloy of the present invention, the P value is always less than 4500. For example, in the TMS-138 alloy, the P value comes to about 4485.7, although its Cr content is 2.9 wt % which is the same as the upper limit of Cr content of the alloy of the U.S. Pat. No. '645. Therefore, with regard to P value, the alloy of the present invention is not covered by U.S. Pat. No. '645.

What is claimed is:

1. A Ni-based single crystal super alloy having a composition consisting of 5.0–7.0 wt % Al, 4.0–8.0 wt % Ta, 2.9–4.5 wt % Mo, 4.0–8.0 wt % W, 3.0–6.0 wt % Re, 0.01–0.50 wt % Hf, 3.0–5.0 wt % Cr, 0.1–9.5 wt % Co, and 1.0–4.0 wt % Ru in terms of its weight ratio, with the remainder consisting of Ni and unavoidable impurities; and wherein when the lattice constant of the matrix is taken to be a1 and the lattice constant of the precipitation phase is taken to be a2, $a2 \leqq 0.999a1$.

2. A Ni-based single crystal super alloy having a composition consisting of 5.0–7.0 wt % Al, 4.0–6.0 wt % Ta, 1.0–4.5 wt % Mo, 4.0–8.0 wt % W, 3.0–6.0 wt % Re, 0.01–0.50 wt % Hf, 3.0–5.0 wt % Cr, 0.1–9.5 wt % Co, and 1.0–4.0 wt % Ru in terms of weight ratio, with the remainder consisting of Ni and unavoidable impurities; and wherein when the lattice constant of the matrix is taken to be a1 and the lattice constant of the precipitation phase is taken to be a2, $a2 \leqq 0.999a1$.

3. A Ni-based single crystal super alloy having a composition consisting of 5.0–7.0 wt % Al, 4.0–6.0 wt % Ta, 2.9–4.5 wt % Mo, 4.0–8.0 wt % W, 3.0–6.0 wt % Re, 0.01–0.50 wt % Hf, 3.0–5.0 wt % Cr, 0.1–9.5 wt % Co, and 1.0–4.0 wt % Ru in terms of weight ratio, with the remainder consisting of Ni and unavoidable impurities; and wherein when the lattice constant of the matrix is taken to be a1 and the lattice constant of the precipitation phase is taken to be a2, $a2 \leqq 0.999a1$.

4. The Ni-based single crystal super alloy according to claim 1 wherein the P value which is equal to −200 Cr+80 Mo−20 $Mo^2$+200 W−14 $W^2$+30 Ta−1.5 $Ta^2$+2.5 Co+1200 Al−100 $Al^2$+100 Re+1000 Hf−2000 $Hf^2$+700 $Hf^3$, wherein all elements in the formula are in wt % amounts, is less than 4500.

5. The Ni-based single crystal super alloy according to claim 2 wherein the P value which is equal to −200 Cr+80 Mo−20 $Mo^2$+200 W−14 $W^2$+30 Ta−1.5 $Ta^2$+2.5 Co+1200 Al−100 $Al^{2+100}$ Re+1000 Hf−2000 $Hf^2$+700 $Hf^3$, wherein all elements in the formula are in wt % amounts, is less than 4500.

6. The Ni-based single crystal super alloy according to claim 3 wherein the P value which is equal to −200 Cr+80 Mo−20 $Mo^2$+200W−14 $W^2$+30 Ta−1.5 $Ta^2$+2.5 Co+1200 Al−100 $Al^2$+100 Re+1000 Hf−2000 $Hf^2$+700 $Hf^3$, wherein all elements in the formula are in wt % amounts, is less than 4500.

* * * * *